US006343882B1

(12) United States Patent
Chang et al.

(10) Patent No.: US 6,343,882 B1
(45) Date of Patent: Feb. 5, 2002

(54) APPARATUS FOR DEVELOPING A PIXEL-DEFINING LAYER OF AN ORGANIC LIGHT EMITTING DIODE

(75) Inventors: Yih Chang, Chung-Ho; Tien-Rong Lu, Tainan, both of (TW)

(73) Assignee: Ritek Corporation (TW)

( * ) Notice: Subject to any disclaimer, the term of this patent is extended or adjusted under 35 U.S.C. 154(b) by 0 days.

(21) Appl. No.: 09/564,699

(22) Filed: May 4, 2000

(51) Int. Cl.[7] ..... G03D 5/00

(52) U.S. Cl. ..... 396/611; 29/25.01; 700/121; 700/217; 250/492.1; 118/52; 414/940

(58) Field of Search ..... 396/611, 612; 118/52, 56, 314–321, 500, 666–668, 715, 725; 414/935–941; 29/25.01; 250/492.1; 430/311, 313; 700/101, 121, 217

(56) References Cited

U.S. PATENT DOCUMENTS 5,763,892 A * 6/1998 Kizaki et al. ..... 250/492.1
5,789,141 A * 8/1998 Usujima ..... 430/313

FOREIGN PATENT DOCUMENTS

EP 986112 * 11/2000

* cited by examiner

*Primary Examiner*—D. Rutledge
(74) *Attorney, Agent, or Firm*—Lowe Hauptman Gilman & Berner

(57) ABSTRACT

An apparatus for developing a pixel-defining layer of an organic light emitting diode (OLED) display panel. The apparatus has a developing unit, a cleaning unit, a drying unit, a conveying unit and a control unit. The conveying unit transports the display panel to each of the connected units. The control unit determines a conveying order and a conveying time of the conveying unit so as to precisely control a processing time of the display panel in each of the units connected with the conveying unit. The conveying unit continuously transports the display panel to the developing unit, the cleaning unit and the drying unit in sequence to complete the developing process. Thereby, the apparatus can precisely control the predetermined developing time, the quality of pixel-defining layers and effectively reduce the period of the developing process and the labor cost.

21 Claims, 5 Drawing Sheets

APPARATUS FOR DEVELOPING A PIXEL-DEFINING LAYER OF AN ORGANIC LIGHT EMITTING DIODE

BACKGROUND OF THE INVENTION

1. Field of the Invention

The present invention relates to an apparatus, and more particularly, to an apparatus for developing a pixel-defining layer of an organic light emitting diode.

2. Description of the Prior Art

Currently, an organic light emitting diode (OLED) display with light weight, high contrast, fast response speed, low power consumption and high brightness becomes the focus of the innovative generation display. However, compared with other mature displays, since the OLED display panel is the latest without perfect technique available, there are many difficulties in commercialization and mass production.

The OLED panel comprises a plurality of ITO anode electrodes, a plurality of photoresist separating walls perpendicularly positioned on the anode electrodes, an organic electroluminescent layer positioned between two adjacent photoresist separating walls on the anode electrodes, and a plurality of cathodes positioned on the organic electroluminescent layer. The anode and the cathode sandwich and the organic electroluminescent layer form a luminescent pixel of the OLED panel. In addition, a pixel-defining layer is created between the anodes and the photoresist separating walls to define the pixel pattern and dimension of the anodes. Also, the pixel-defining layer can isolate the anode and the cathode that laterally diffuses from the photoresist separating wall to promote the luminescent performance of the OLED panel.

In general, the pixel-defining layer is made of photoresist or polyimide (PI) wherein the PI with thermal, mechanical and electric stability is able to enhance the luminescent stability and the lifetime of the OLED panel. The method of forming the pixel-defining layer comprises the steps of coating the PI or the PI precursor, pre-baking, exposure, post exposure baking, development and curing. In the prior art of the development employed in semiconductor process or photoelectric process, a silicon substrate placed on a spinner is rotated and then the developer and the cleaning solution are sprayed on the silicon substrate. Next, the silicon substrate is spun at a high speed to remove the cleaning solution. Nevertheless, the traditional spinner can not bear the weight of the panel and the centrifugal force at a high rotary speed as the display panel with heavier glass substrate is enlarged followed by technical advances. This leads to imperfect development, remaining developer and in uniform pattern those greatly reduce the quality and yield of the display panel. Though the display panel can be immersed in a developing bath trough and a cleaning trough respectively to solve the above-mentioned problems, it still needs operators to deliver the display panel between two steps which will prolong the period time of the developing process. It is unfavorable to the mass production, especially to the display panel with large size. Also, it is not easy to control the delivering delay or damage resulted from the operators. Therefore, the prior art of the apparatus neither precisely control the developing time, nor ensure the quality of the developing process.

As for the polyimide, the chemical property of the polyimide remains unstable and easily damaged by alkaline solution before performing the final steps of the curing at the temperature between 220° C. and 350° C. Hence, it is needed to precisely control the developing time to prevent the polyimide being over etched by the developer. As for the nonphotosensitive polyimide, the development comprises the development of a photoresist layer and the etching of the nonphotosensitive polyimide not covered by the photoresist layer. If the developing time can not be controlled precisely, the polyimide could be over etched by the TMAH developer to damage the pattern of the PI pixel-defining layer and even make the polyimide stripped.

SUMMARY OF THE INVENTION

It is therefore a primary objective of the present invention to provide an apparatus for developing a pixel-defining layer of an OLED panel, which continuously conveys the display panel to each unit, shortens the period time of the developing process and applies to a mass production of the display panel with varied size.

In a preferred embodiment, the present invention provides an apparatus for developing a pixel-defining layer of an OLED panel. The apparatus comprises a developing unit for providing a developer on the display panel to persist a predetermined developing time; a cleaning unit for spraying a cleaning solution to remove the developer remaining on the display panel; a drying unit for drying the cleaning solution remaining on the display panel; a conveying unit for conveying the display panel to each of the connected units; and a control unit for determining a conveying sequence and a conveying time of the conveying unit so as to precisely control a processing time of the display panel in each of the units connected with the conveying unit. The conveying unit continuously conveys the display panel to the developing unit, the cleaning unit and the drying unit in sequence to complete the developing process, so the apparatus can precisely control the predetermined developing time, the quality of pixel-defining layers and effectively reduce the period of the developing process and the labor cost.

Besides, the apparatus can establish a plurality of developing units connected with each other to selectively employ the developing units depending on the request of maintenance or the developing process. Furthermore, the apparatus can establish a first stage cleaning unit for spraying a recycled cleaning solution and elementarily remove the developer, and a second stage cleaning unit for spraying a fresh cleaning solution and completely remove the developer. The used cleaning solution in the second stage cleaning unit is recycled to be the recycled cleaning solution in the first stage cleaning unit.

It is an advantage of the present invention that the apparatus precisely controls the predetermined developing time and possesses many options of using the developing units depending on the need of maintenance and the developing process. Also, it protects environment and reduces production cost by recycling the used TMAH and cleaning solution. Furthermore, it improves the lifetime and the operation efficiency of the apparatus.

This and other objective of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

The First Embodiment

Figure 1:
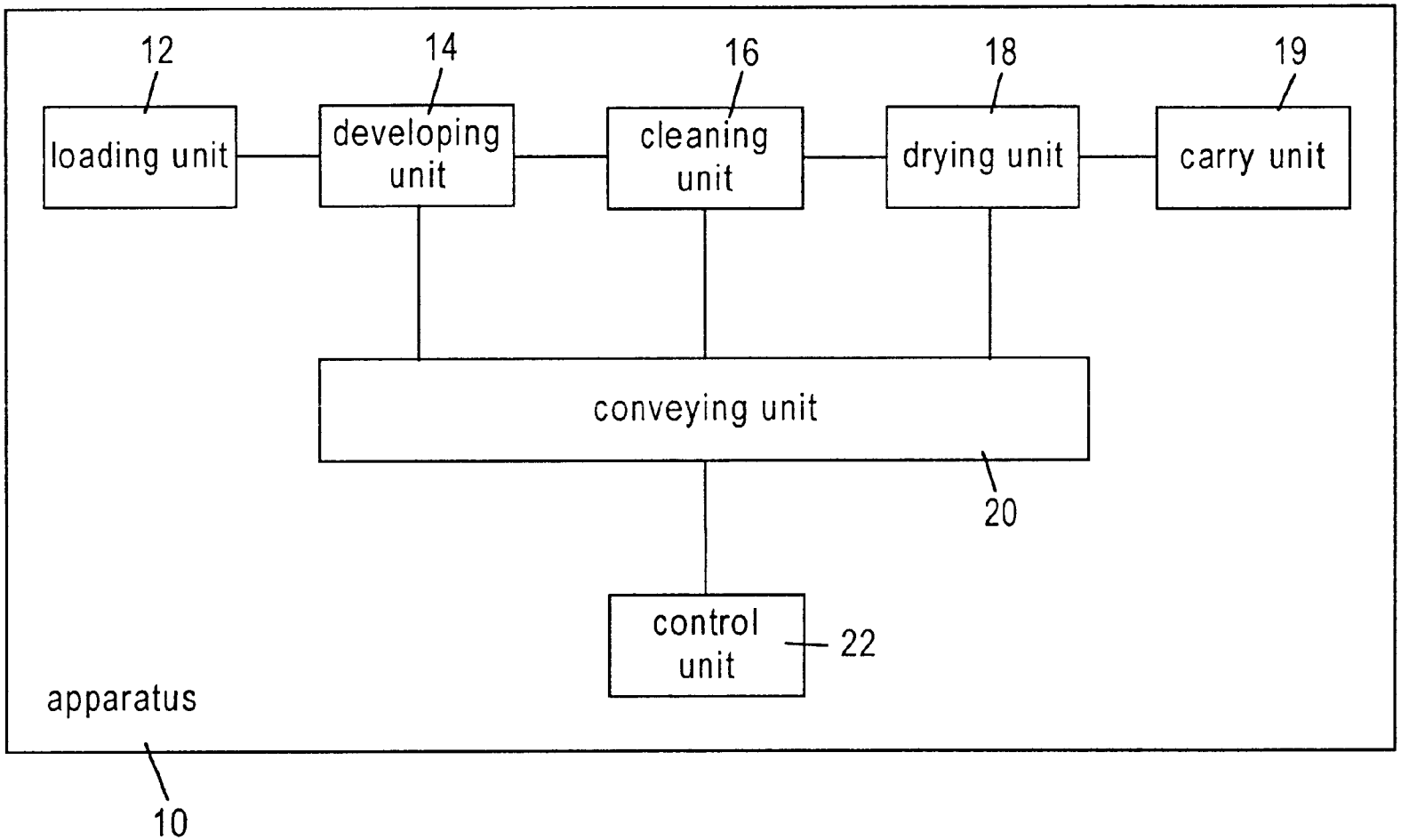
FIG. 1 is a block diagram of an apparatus according to the first embodiment of the present invention.

A block diagram of an apparatus 10 according to the first embodiment of the present invention is revealed in FIG. 1. The first embodiment of the present invention provides an apparatus 10 for performing a developing process on a polyimide (PI) pixel-defining layer of an OLED panel so as to define a pixel pattern and dimension of a plurality of ITO anodes. The apparatus 10 comprises a loading unit 12 for loading the display panel, a developing unit 14 connected with the loading unit 12, a cleaning unit 16 connected with the developing unit 14, a drying unit 18 connected with the cleaning unit 16, a carry unit 19 connected with the drying unit 18, a conveying unit 20 connected with the developing unit 14, the cleaning unit 16 and the drying unit 18, the carry unit 19, and a controlling unit 22 connected with the conveying unit 20.

The control unit 22 determines a conveying order and a conveying time of the conveying unit 20 to make the conveying unit 20 continuously convey the display panel to the developing unit 14, the cleaning unit 16, the drying unit 18 and the carry unit 19 in sequence. Therefore, a processing time of the display panel in the developing unit 14, the cleaning unit 16, the drying unit 18 and the carry unit 19 can be precisely controlled respectively. The developing unit 14 provides a developer that uniformly spreads on the display panel and persists a predetermined developing time. The cleaning unit 16 sprays a cleaning solution to remove the developer remaining on the display panel. The drying unit 18 dries the cleaning solution remaining on the display panel. The carry unit 19 downloads the completed display panel or provides a buffering area to directly convey the completed display panel to a photoresist stripping apparatus. The conveying unit 20 is a roller transmission unit (not shown) that comprises a plurality of inner ring rollers and outer ring rollers positioned at two ends of a roller axle. The inner ring rollers receive the display panel, and the outer ring rollers fix the transverse relative position of the display panel in the roller transmission unit. Furthermore, it can adjust a distance between the rollers respectively positioned at the two end of the roller axle depending on the width of the display panel. Hence, it applies to the mass production of the display panel with varied size.

Figure 2:
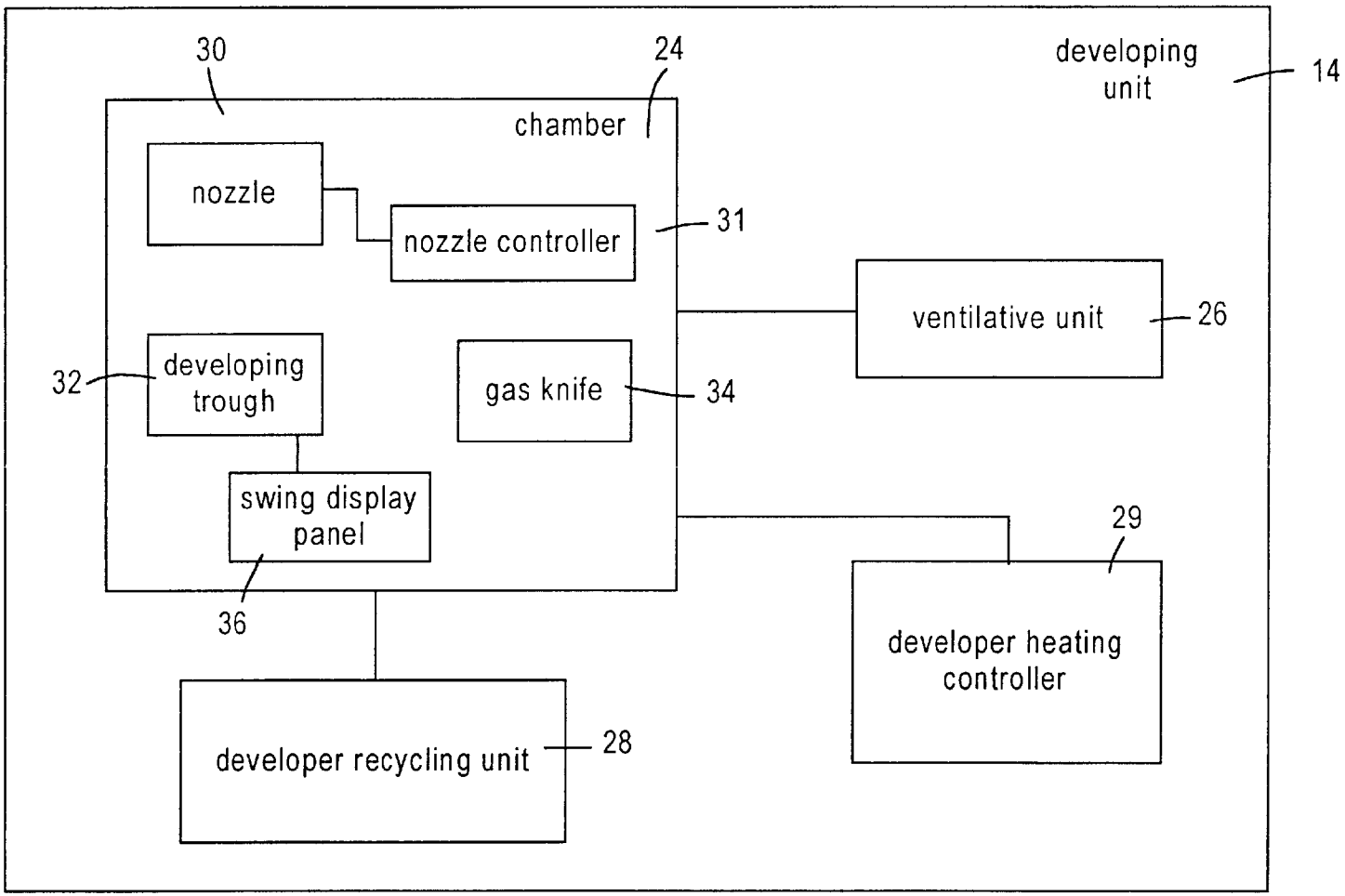
FIG. 2 is a block diagram of the developing unit shown in FIG.1.

Please refer to FIG. 2. FIG. 2 is a block diagram of the developing unit 14 shown in FIG. 1. The developing unit 14 comprises a chamber 24, a ventilative unit 26, a developer heating controller 29 and a developer recycling unit 28 which are respectively connected with the chamber 24. The ventilative unit 26 provides the chamber 24 the needed inert gas such as nitrogen ($N_2$) or argon (Ar) for preventing the oxidation of the polyimide pixel-defining layer. The developer heating controller 29 controls the temperature of the developer, and the developer recycling unit 28 recycles the used developer. The chamber 24 comprises nozzles 30 for spraying the developer, a nozzle controller 31 for controlling a spraying pressure of the developer in the nozzles 30 by a pump, a developing trough 32 for swinging the display panel sprayed with the developer, and at least one gas knife 34 positioned at the end of the chamber 24 for scraping the superfluous developer on the display panel and reducing the developer which will contaminate the cleaning unit 16.

When the display panel is conveyed from the loading unit 12 to the chamber 24 of the developing unit 14, the nozzles 30 spray the developer on the display panel, and the nozzle controller 31 controls the spraying pressure of the developer in the nozzles 30 to increase the spreading uniformity of the developer. Then, the display panel placed in the developing trough 32 is swung using a swing display panel 36 to make the sprayed developer uniformly spread on the display panel. Besides, the display panel can be directly immersed in the developer that is filled in the developing trough 32 and swung at the same time. Furthermore, the above-mentioned ways of spraying and immersing can be used simultaneously to gain the uniformity of the developer in a shorter period of time. Compared with the way of rotating the display panel of the prior art, the way of swinging the display panel of the present invention can prevent the chamber 24 from being contaminated by developer according to overly rotation. Also, it can increase the amount of the recycling developer. The gas knife 34 that scraps the superfluous developer on the display panel before the display panel is conveyed to the cleaning unit 16 can not only increase the amount of the recycling developer, but also reduce the amount of the cleaning solution used in the cleaning unit 16.

As the display panel is performed in the developing unit 14, the control unit 22 determines the spraying time and the swinging time, and the conveying unit 20 conveys the display panel to the cleaning unit 16 immediately when the developer on the display panel lasts the predetermined developing time. Next, the cleaning unit 16 sprays a high-pressure deionized water to remove the developer on the display panel. Then, the display panel is continuously conveyed to the drying unit 18 that dries the display panel by air or a gas knife so as to complete the developing process. Since the controlling unit 22 controls the processing time of each unit and the conveying unit 20 continuously conveys the display panel to each unit in sequence, the apparatus 10 can precisely control the predetermined developing time, the quality of pixel-defining layers and reduce the labor cost. Also, the apparatus 10 can effectively reduce the period of the developing process and apply to mass production of the display panel especially for the display panel with big size.

The Second Embodiment

Figure 3:
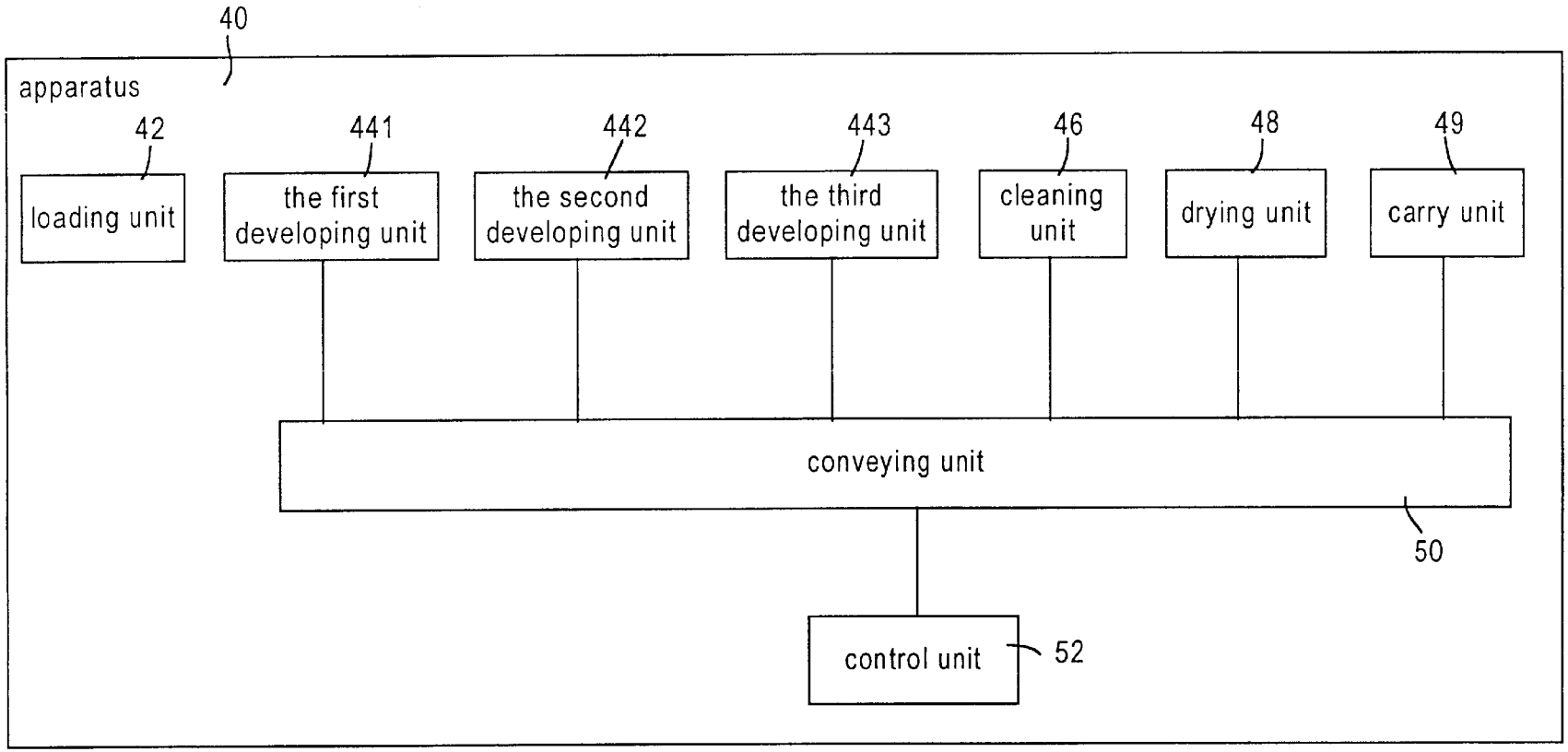
FIG. 3 is a block diagram of an apparatus according to the second embodiment of the present invention.

Please refer to FIG. 3. FIG. 3 is a block diagram of an apparatus 40 according to the second embodiment of the present invention. The apparatus 40 comprises a loading unit 42, a first developing unit 441 connected with the loading unit 42, a second developing unit 442 connected with the first developing unit 441, a third developing unit 443 connected with the second developing unit 442, a cleaning unit 46 connected with the third developing unit 443, a drying unit 48 connected with the cleaning unit 46, a carry unit 49 connected with the drying unit 48, a conveying unit 50 connected with each developing unit 441~443, the cleaning unit 46, the drying unit 48, and the carry unit 49, and a control unit 52 connected with the conveying unit 50.

The control unit 52 determines a conveying order and a conveying time of the conveying unit 50 to make the conveying unit 50 continuously convey the display panel to the first developing unit 441, the second developing unit 442, the third developing unit 443, the cleaning unit 46,the drying unit 48 and the carry unit 49 in sequence. Therefore, a processing time of the display panel in the developing units 441~443, the cleaning unit 46, the drying unit 48 and the carry unit 49 can be precisely controlled respectively. The equipment or use of each developing units 441~443, the cleaning unit 46, the drying unit 48 and the carry unit 49 is the same as described in the first embodiment.

The apparatus 40 can selectively employ the first developing unit 441, the second developing unit 442 or the third developing unit 443 depending on the need of maintenance and the request of the developing condition. The control unit 52 can control the processing time of the display panel in the selective developing unit to precisely control the amount of developer and the predetermined developing time. For example, during a mass production, the apparatus 40 can employ every developing unit at the same time to triple the throughput. If one of the three developing units is in need of maintenance or replenishing the developer, the apparatus 40 can choose the other developing units to continuously operate the apparatus 40. Besides, if the developing process requests many kinds of developer solutions with different concentration, each kind of developer solution can be filled in each developing unit. That is, the apparatus 40 can perform three kinds of developing processes at the same time.

According to the above description, the apparatus 40 with at least two developing units and a way of continuously conveying the display panel can not only reduce the period time of the developing process, but also increase the selectivity and flexibility of using. It is helpful to promote the process capability and operation efficiency of the apparatus 40.

The Third Embodiment

Figure 4:
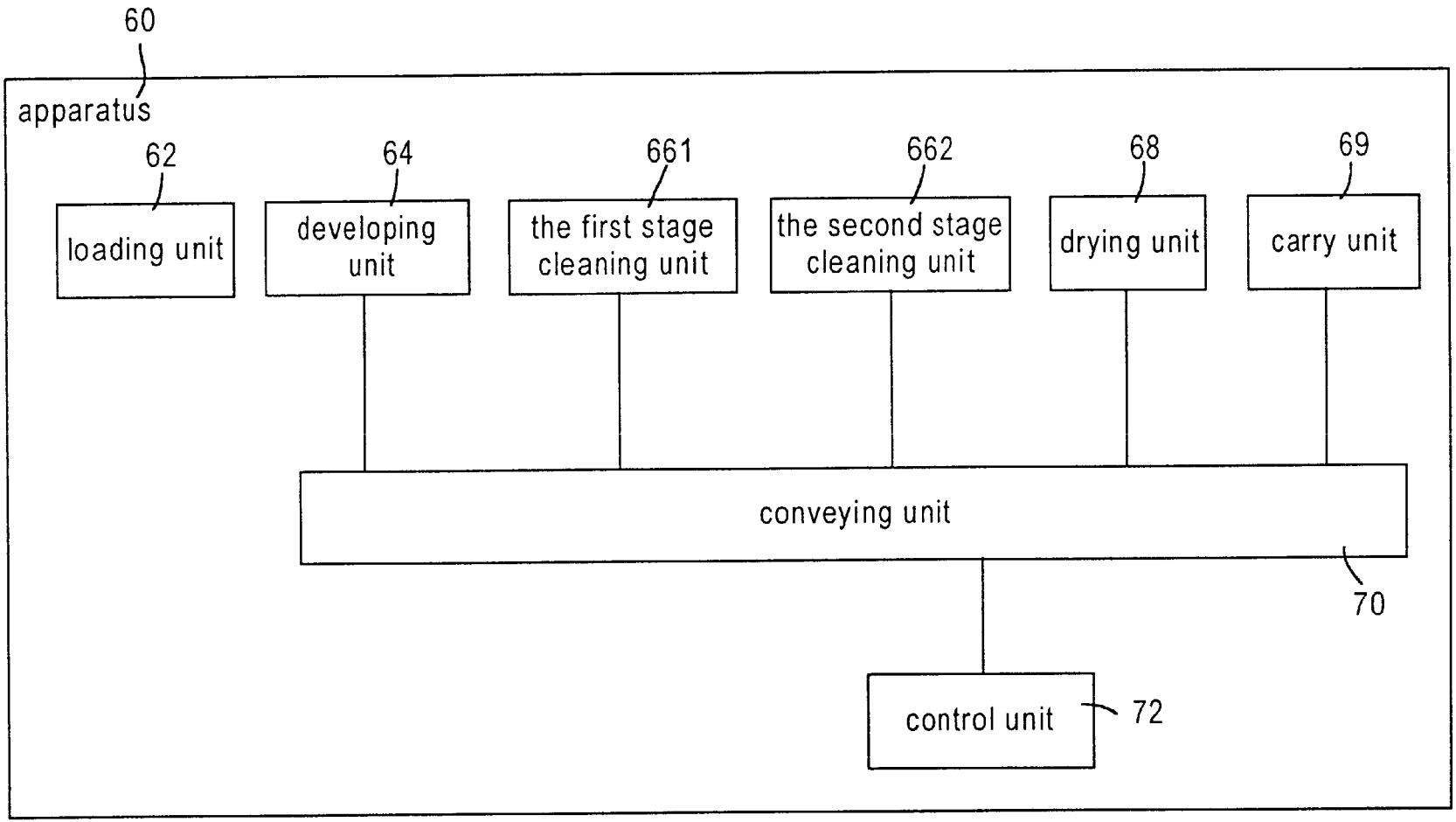
FIG. 4 is a block diagram of an apparatus according to the third embodiment of the present invention.

Please refer to FIG. 4. FIG. 4 is a block diagram of an apparatus according to the third embodiment of the present invention. An apparatus comprises a loading unit 62, a developing unit 64 connected with the loading unit 62, a first stage cleaning unit 661 connected with the developing unit 64, a second stage cleaning unit 662 connected with the first stage cleaning unit 661, a drying unit 68 connected with the second stage cleaning unit 662, a carry unit 69 connected with the drying unit 68, a conveying unit 70 connected with the developing unit 64, the first stage cleaning unit 661, the second stage cleaning unit 662, the drying unit 68 and the carry unit 69, and a control unit 72 connected with the conveying unit 70.

The control unit 72 determines a conveying order and a conveying time of the conveying unit 70 to make the conveying unit 70 continuously convey the display panel to the developing unit 64, the first stage cleaning unit 661, the second stage cleaning unit 662, the drying unit 68 and the carry unit 69 in sequence. Therefore, a processing time of the display panel in the developing unit 64, the first stage cleaning unit 661, the second stage cleaning unit 662, the drying unit 68 and the carry unit 69 can be precisely controlled respectively. The equipment or use of each developing unit 643, the drying unit 68 and the carry unit 69 is the same as described in the first embodiment. The first stage cleaning unit 661 sprays a high-pressure recycling deionized water to elementarily remove the developer remaining on the display panel. The second stage cleaning unit 662 sprays a high-pressure fresh deionized water to completely remove the developer remaining on the display panel Most developer remaining on the display panel is removed in the first stage cleaning unit 661, and few developer still remaining on the display panel is completely removed in the second stage cleaning unit 662. For this reason, the second stage cleaning unit 662 only utilizes a small amount of the high-pressure fresh deionized water to completely remove the developer. It prevents the second stage cleaning unit 662 from being contaminated by the splashed developer and ensures the cleaning quality and the operational capability of the second stage cleaning unit 662. In addition, since the used deionized water is not too dirty to be recycled, the used deionized water will be circulated to the first stage cleaning unit 661 to be the high-pressure recycling cleaning solution.

According to the above description, the apparatus 60 with the two stage cleaning units and the way of continuously conveying the display panel can effectively control the period time of the developing process, the quality of pixel-defining layers and reduce cost. Furthermore, it achieves environmental protection and promotes the operational capability of the apparatus 60.

The Fourth Embodiment

Figure 5:
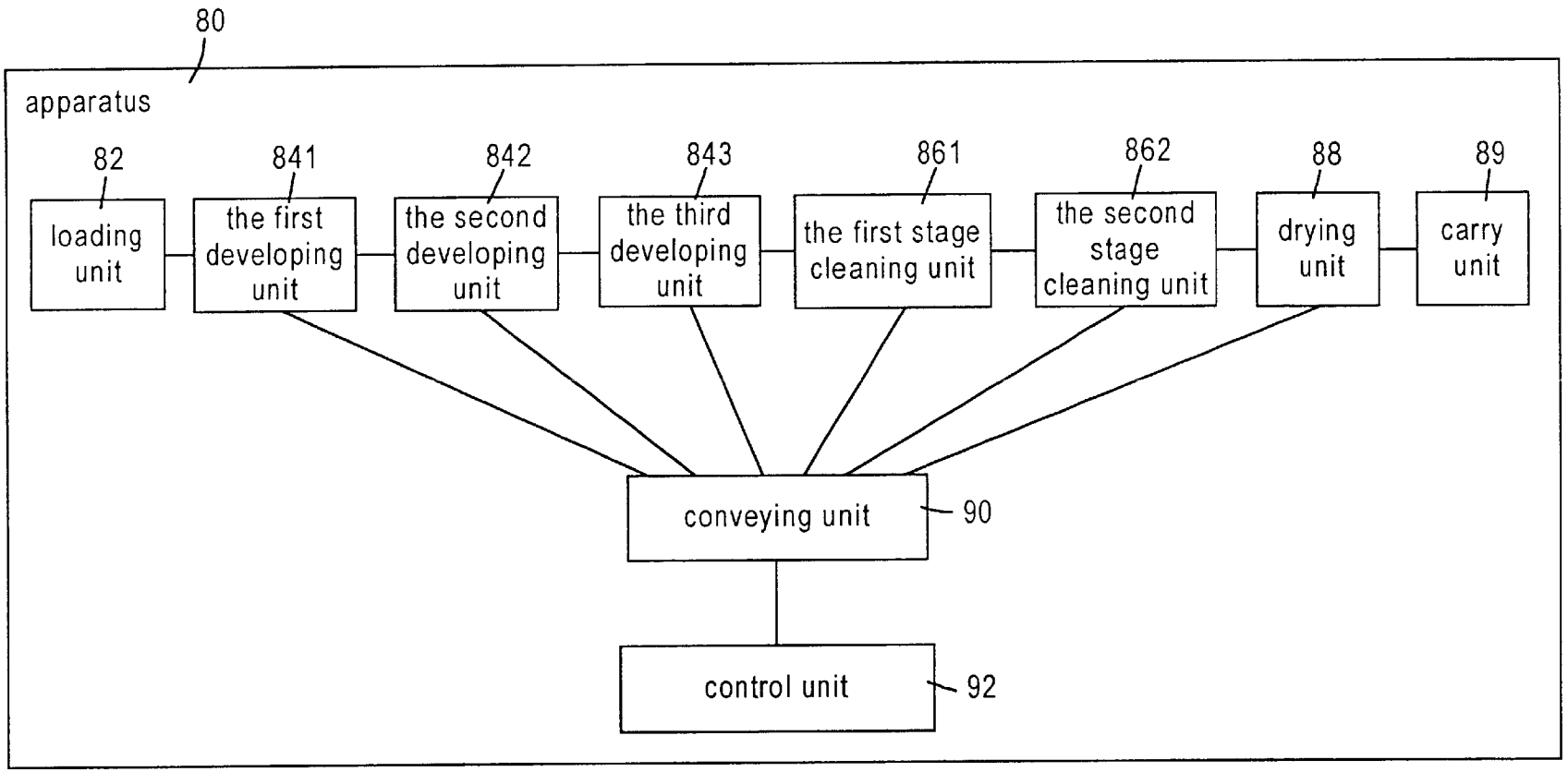
FIG. 5 is a block diagram of an apparatus according to the fourth embodiment of the present invention.

Please refer to FIG. 5. FIG. 5 is a block diagram of an apparatus 80 according to the fourth embodiment of the present invention. An apparatus 80 comprises a loading unit 82, a first developing unit 841 connected with the loading unit 80, a second developing unit 842 connected with the first developing unit 841, a third developing unit 843 connected with the second developing unit 842, a first stage cleaning unit 861 connected with the third developing unit 843, a second stage cleaning unit 862 connected with the first cleaning unit 861, a drying unit 88 connected with the second stage cleaning unit 862, a carry unit 89 connected with the drying unit 88, a conveying unit 90 connected with each developing unit 841~843, each cleaning units 861, 862, the drying unit 88 and the carry unit 89, and a control unit 92 connected with the conveying unit 90.

The control unit 92 determines a conveying order and a conveying time of the conveying unit 90 to make the conveying unit 90 continuously convey the display panel to the first developing unit 841, the second developing unit 842, the third developing unit 843, the first stage cleaning unit 861, the second stage cleaning unit 862, the drying unit 88 and the carry unit 89 in sequence. Therefore, a processing time of the display panel in the first developing unit 841, the second developing unit 842, the third developing unit 843, the first stage cleaning unit 861, the second stage cleaning unit 862,the drying unit 88 and the carry unit 89 can be precisely controlled respectively. The equipment or operation of the developing units 841~843, the drying unit 88 and the carry unit 89 is the same as described in the second embodiment. The equipment or operation of the cleaning units 861~862 is the same as described in the third embodiment.

The apparatus 80 with the three developing units can selectively employ the developing units depending on the need of maintenance and developing process. Also, the apparatus 80 with the two cleaning units can recycle the TMAH and deionized water so as to achieve environmental protection and reduce the production cost. Consequently, the process capability and operation efficiency of the apparatus 80 is improved very much.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. An apparatus for continuously developing a pixel-defining layer of an organic light emitting diode (OLED) display panel, comprising:

a developing unit for providing a developer on the display panel to persist a predetermined developing time;

a cleaning unit connected with the developing unit for spraying a cleaning solution to remove the developer in the display panel;

a drying unit connected with the cleaning unit for drying the cleaning solution remaining on the display panel;

a continuous conveying unit connected with the developing unit, the cleaning unit and the drying unit for conveying the display panel to each of the connected units; and a control unit for determining a continuous conveying order and a conveying time of the conveying unit so as to precisely control a processing time of the display panel in each of the units connected with the conveying unit;

wherein the conveying unit continuously conveys the display panel to the developing unit, the cleaning unit and the drying unit in sequence to thereby precisely control the predetermined developing time and effectively reduce the period of the developing process.

2. The apparatus of claim 1, further comprising a carry unit connected with the drying unit to either download the completed display panel or provide a buffering area to directly convey the completed display panel to a photoresist stripping apparatus.

3. The apparatus of claim 1 wherein the developing unit employs a nozzle controller to control a spraying pressure of the developer in nozzles and a way of swinging the display panel to make the sprayed developer uniformly spread on the display panel.

4. The apparatus of claim 3, wherein the developing unit further comprises at least one gas knife positioned at the end of the developing unit for scraping the superfluous developer on the display panel.

5. The apparatus of claim 3, wherein the developing unit further comprises a developer recycling unit for recycling the used developer and a developer heating controller for controlling the temperature of the developer.

6. The apparatus of claim 1, wherein the drying unit employs gas knife scraping to remove the cleaning solution remaining on the display panel.

7. The apparatus of claim 1, wherein the apparatus performs the developing process to define a pixel pattern and dimension on the display panel.

8. An apparatus for developing a pixel-defining layer of an organic light emitting diode (OLED) display panel, comprising:

a plurality of developing units connected in series, each of the developing unit providing a developer on the display panel to persist a predetermined developing time;

a cleaning unit connected with the rear developing unit for spraying a cleaning solution to remove the developer remaining on the display panel, a drying unit connected with the cleaning unit for drying the cleaning solution remaining on the display panel;

a conveying unit connected with the developing unit, the cleaning unit and the drying unit for continuously conveying the display panel to the plurality of the developing units, the cleaning unit and the drying unit in sequence; and a control unit for determining a conveying order and a conveying time of the conveying unit so as to precisely control a processing time of the display panel in each of the units connected with the conveying unit respectively;

wherein the apparatus can selectively employ the plurality of the developing units depending on the need of repair, maintenance and the request of the developing process, and the control unit can determine the processing time of the display panel in the flexible developing unit so as to precisely control the predetermined developing time and the quality of pixel-defining layers.

9. The apparatus of claim 8, further comprising a carry unit connected with the drying unit to either download the completed display panel or provide a buffering area to directly convey the completed display panel to a photoresist stripping apparatus.

10. The apparatus of claim 8, wherein the developing unit employs a nozzle controller to control a spraying pressure of the developer in nozzles and a swing display panel to make the sprayed developer uniformly spread on the display panel.

11. The apparatus of claim 10, wherein the developing unit further comprises at least one gas knife positioned at the end of the developing unit for scraping the superfluous developer on the display panel.

12.The apparatus of claim 10, wherein the developing unit further comprises a developer recycling unit for recycling the used developer and a developer heating controller for controlling the temperature of the developer.

13. The apparatus of claim 8, wherein the drying unit employs gas knife scraping to remove the cleaning solution remaining on the display panel.

14. The apparatus of claim 8, wherein the apparatus performs the developing process to define a pixel pattern and dimension on the display panel.

15. An apparatus for developing a pixel-defining layer of an organic light emitting diode (OLED) display panel, comprising:

a developing unit for providing a developer on the display panel to persist a predetermined developing time;

a first stage cleaning unit connected with the developing unit for spraying a recycling cleaning solution to elementarily remove the developer remaining on the display panel;

a second stage cleaning unit connected with the first stage cleaning unit for spraying a fresh cleaning solution to completely remove the developer remaining on the display panel;

a drying unit connected with the second stage cleaning unit for drying the cleaning solution remaining on the display panel;

a conveying unit connected with the developing unit, the cleaning unit and the drying unit for continuously conveying the display panel to the developing units, the first stage cleaning unit, the second stage cleaning unit and the drying unit in sequence; and a control unit for determining a conveying order and a conveying time of the conveying unit so as to precisely control a processing time of the display panel in each of the units connected with the conveying unit;

wherein the cleaning solution used in the second stage cleaning unit is circulated to the first stage cleaning unit to be the recycling cleaning solution.

16. The apparatus of claim 15, further comprising a carry unit connected with the drying unit to either download the completed display panel or provide a buffering area to directly convey the completed display panel to a photoresist stripping apparatus.

17. The apparatus of claim 15, wherein the developing unit employs a nozzle controller to control a spraying pressure of the developer in nozzles and a swing display panel to make the sprayed developer uniformly spread on the display panel.

18. The apparatus of claim 17, wherein the developing unit further comprises at least one gas knife positioned at the end of the developing unit for scraping the superfluous developer on the display panel.

19. The apparatus of claim 17, wherein the developing unit further comprises a developer recycling unit for recycling the used developer and a developer heating controller for controlling the temperature of the developer.

20. The apparatus of claim 15, wherein the drying unit employs gas knife scraping to remove the cleaning solution remaining on the display panel.

21. The apparatus of claim 15, wherein the apparatus performs the developing process to define a pixel pattern and dimension on the display panel.

* * * * *

UNITED STATES PATENT AND TRADEMARK OFFICE

CERTIFICATE OF CORRECTION

PATENT NO. : 6,343,882 B1 
DATED : February 5, 2002
INVENTOR(S) : Yih Chang and Tien-Rong Lu It is certified that error appears in the above-identified patent and that said Letters Patent is hereby corrected as shown below:

Title page,
Item [73], change Assignee to read as follows:

-- [73] Assignee: Ritek Display Technology Co. (TW) --

Signed and Sealed this

Seventeenth Day of December, 2002

JAMES E. ROGAN
*Director of the United States Patent and Trademark Office*